US006793563B2

(12) United States Patent
Daniel

(10) Patent No.: US 6,793,563 B2
(45) Date of Patent: Sep. 21, 2004

(54) PARTICULATE BLASTER ASSEMBLY AND ASPIRATOR

(76) Inventor: Dorce L. Daniel, 100 S. Westwood St., Porterville, CA (US) 93257

( * ) Notice: Subject to any disclaimer, the term of this patent is extended or adjusted under 35 U.S.C. 154(b) by 0 days.

(21) Appl. No.: 10/230,530

(22) Filed: Aug. 28, 2002

(65) Prior Publication Data

US 2004/0043711 A1 Mar. 4, 2004

(51) Int. Cl.[7] ..... B24C 5/04
(52) U.S. Cl. ..... 451/90; 451/99
(58) Field of Search ..... 457/90, 99; 222/204, 222/205, 249; 221/228; 239/320

(56) References Cited

U.S. PATENT DOCUMENTS

| | | | | | |
|---|---|---|---|---|---|
| 2,574,578 | A | * | 11/1951 | Martinet | 43/124 |
| 2,723,498 | A | * | 11/1955 | Hastrup et al. | 451/88 |
| 3,032,929 | A | * | 5/1962 | Glesener | 451/90 |
| 3,163,963 | A | | 1/1965 | Caron | |
| 3,570,716 | A | * | 3/1971 | Kirsanoff et al. | 406/32 |
| 3,750,340 | A | * | 8/1973 | Anderson | 451/99 |
| 3,776,459 | A | * | 12/1973 | Bonvicini | 239/77 |
| 4,067,150 | A | * | 1/1978 | Merrigan | 451/99 |
| 4,089,441 | A | | 5/1978 | Cole et al. | |
| 4,090,334 | A | * | 5/1978 | Kurowski et al. | 451/90 |
| 4,333,277 | A | * | 6/1982 | Tasedan | 451/88 |
| 4,369,607 | A | * | 1/1983 | Bruggeman et al. | 451/90 |
| 4,474,327 | A | | 10/1984 | Mattson et al. | |
| 4,674,239 | A | * | 6/1987 | Jodoin | 451/87 |
| 4,817,235 | A | | 4/1989 | Doxey et al. | |
| 5,190,225 | A | | 3/1993 | Williams | |
| 5,272,858 | A | | 12/1993 | Bonis | |
| 5,429,278 | A | | 7/1995 | Sansalone | |
| 5,779,161 | A | * | 7/1998 | Dvorak | 239/654 |
| 5,887,578 | A | * | 3/1999 | Backeris et al. | 124/49 |
| 5,947,384 | A | | 9/1999 | McCauley | |
| 5,964,420 | A | | 10/1999 | Hampton | |
| 2002/0139875 | A1 | * | 10/2002 | Barnett | 239/653 |

* cited by examiner

*Primary Examiner*—M. Rachuba
(74) *Attorney, Agent, or Firm*—Dorsey & Whitney LLP

(57) ABSTRACT

A particulate blaster assembly (100) for use as an attachment to a portable air blower (150) includes an air directing tube (110), a vacuum generating assembly (120), and a particulate material aspirator (130). The air directing tube (110) has an inlet end (112) formed for coupling to the air blower (150) to receive air discharged therefrom and a movable exhaust end (114) formed for discharge of air and particulate material (212) entrained in the air toward a target site (160). The vacuum assembly (120) is coupled to the air directing tube (110) and formed to produce a partial vacuum as air passes in the tube (110) over the vacuum generating assembly (120). The particulate material aspirator (130) is coupled to the vacuum assembly (120) and is responsive to the partial vacuum generated by the vacuum generating assembly (120) to aspirate a particulate material (212) from a particulate material source (340) into the air directing tube (110) for acceleration and discharge of the entrained particulate material (212). Preferably, a positive pressure, generating assembly (182) communicates positive pressure to aspirator (130) for cooperation with the partial vacuum at the aspirator (130) to aspirate particulate material (212) into the air directing tube (110).

20 Claims, 4 Drawing Sheets

PARTICULATE BLASTER ASSEMBLY AND ASPIRATOR

BACKGROUND OF THE INVENTION

1. Field of the Invention

This invention relates, in general, to sandblasters, and more particularly, relates to highly portable particulate blaster devices.

2. Description of Related Art

Sandblasters entrain a hard particulate material, typically fine sand, in a stream of air which can be directed against a target site to be ablated or abrasively eroded by the sand. Thus, the rapidly moving sand will hit the target site with considerable force and thereby remove surface material, for example, mold, rust, paint, and similar abradable substances. Unfortunately, conventional sandblasters are usually quite massive and require bulky air compressors and expensive equipment dedicated specifically to sandblasting.

One wide spread use of sandblasting equipment is the removal of graffiti, particularly from concrete structures. Private property owners and municipalities have a substantial continuing graffiti problem and it is often periodically addressed by sandblasting. The "portable" sandblasting equipment used, however, is usually a large compressor/sand carrying truck fitted with long high pressure bases that can extend from the truck to the structure having graffiti which is to be removed. Such sandblasting equipment is expensive to own or lease, and as a result, graffiti removal is often a long deferred maintenance problem.

What is needed is a particulate or sandblaster assembly which is highly portable, easy to operate and low in cost and yet highly effective for many sandblasting applications.

BRIEF SUMMARY OF THE INVENTION

In summary, one aspect of the present invention is directed to a particulate blaster assembly for use as an attachment to an air blower which includes a tube, a vacuum assembly, and a particulate material aspirator. The air directing tube has an inlet end formed for coupling to the air blower, and most preferably a portable leaf blower, to receive air discharged therefrom and has a movable exhaust end formed for discharge of air and particulate material entrained in the air toward a target site. The vacuum assembly is fluid coupled to the air directing tube and formed to produce a vacuum as air passes down the air directing tube. The particulate material aspirator is fluid coupled to the vacuum assembly and responsive to vacuum generated by the vacuum assembly to aspirate a particulate material, such as sand, from a particulate material source and communicate the particulate material to the air directing tube for acceleration of the particulate material in the tube and discharge of air and entrained particulate material from the exhaust end of the tube.

Another aspect of the present invention is directed to a particulate material aspirator assembly for the blaster which is responsive to a vacuum source to aspirate particulate material from a particulate material source, usually a portable source such as a bucket filled with sand. The aspirator assembly includes a base gravity support on a top surface of the sand in the container. A vacuum conduit, passing through the base, extends below the base and has an open vacuum end for aspirating the particulate material from the container. An opposite end of the vacuum conduit is coupled to the vacuum generating structure. Most preferably, the aspirator assembly also includes a pressure conduit mounted to the base and having an inlet end coupled to a source of pressure and an open pressure end extending below the base to a position proximate the open vacuum of the vacuum conduit. The vacuum conduit and the pressure conduit may be movably mounted to the base to vary the distance between the open vacuum end and the open pressure end so as to enhance the cooperative pressure and vacuum in fluidizing the particulate material and entraining it in the air being communicated to the air directing tube. The open vacuum end and the open pressure end preferably extend below the base by a vertical distance greater than the height of the angle of repose of the particulate material.

The particulate blaster assembly and aspirator of the present invention has other features and advantages which will be apparent from, or are set forth in more detail in, the accompanying drawings, which are incorporated in and form a part of this specification, and the following Best Mode of Carrying Out the Invention, which together serve to explain the principles of the present invention.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
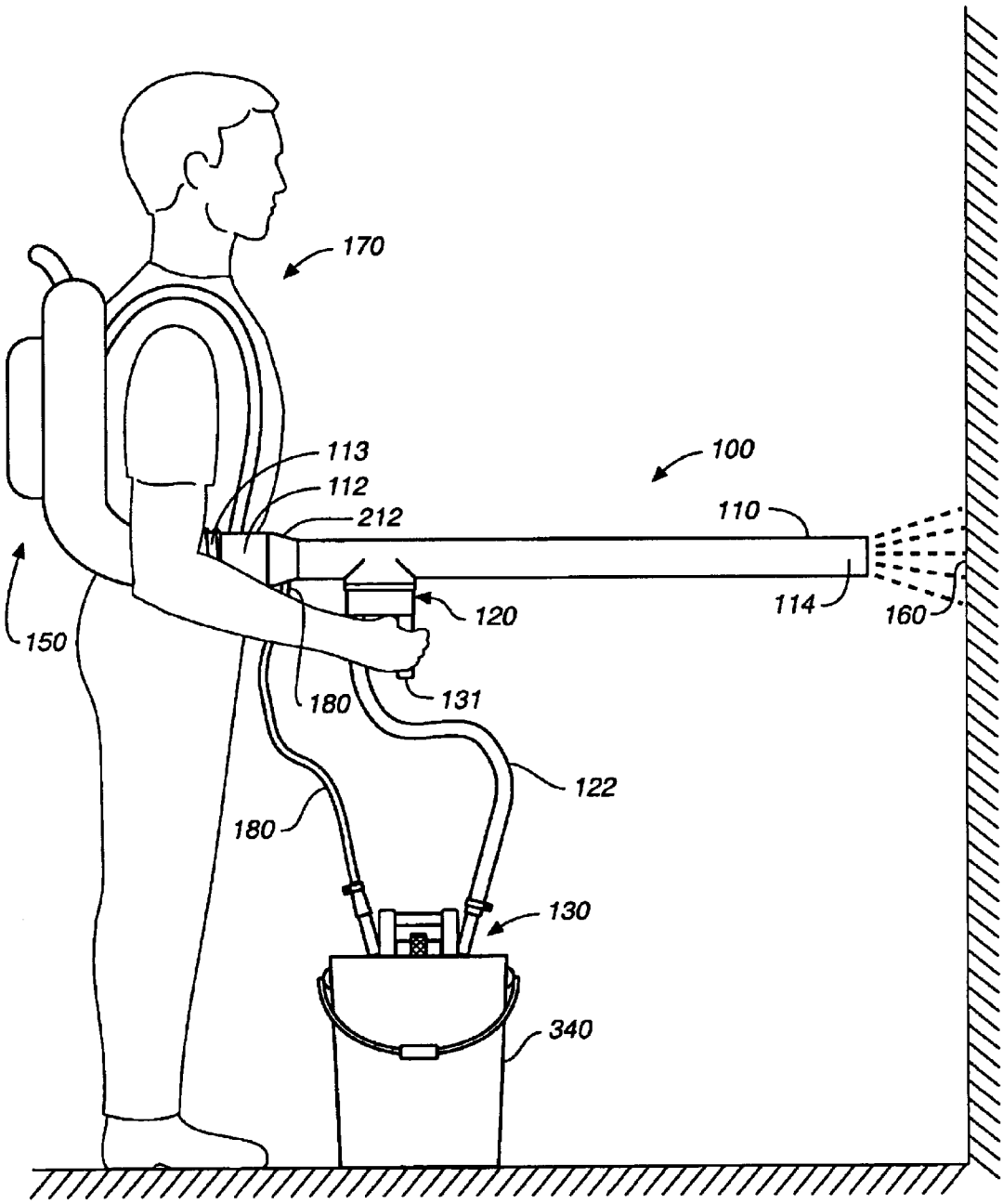
FIG. 1 is a side elevation view of a particulate blaster assembly constructed in accordance with the present invention.

Turning now to the drawings, wherein like components are designated by like reference numerals throughout the various figures, attention is directed to FIG. 1, where a particulate blaster assembly, generally designated 100, is illustrated. Particulate blaster assembly 100 includes an air directing tube 110, a vacuum generating assembly, generally designated 120, and a particulate material aspirator, generally designated 130. The air directing tube includes an inlet end 112 and a movable exhaust end 114. The inlet end 112 is formed for coupling, for example by flex coupling 113, to a gas source, which is most preferably a portable air blower 150, to receive air discharged therefrom. The exhaust end 114 is formed for discharge of the particulate material entrained in the air toward a target site 160.

In the most preferred embodiment, operator 170 carries a backpack type of leaf blower 150 coupled with particulate blaster assembly 100 being one of several attachments which can be used with the leaf blower. The operator 170 directs the air and particulate material entrained therein by moving the air directing tube 110 and exhaust end 114 while flexing couple 113 in a manner analogous to blowing leaves. The particulate material aspirator 130 may be placed in a portable source 340, such as a bucket, of particulate material, such as sand. Bucket 340 can be placed on the ground in proximity to target 160 and moved by operator 170, as needed.

As shown in FIG. 1, the air directing tube 110 is held by the operator 170 and coupled to particulate material aspirator 130 by a flexible vacuum tube 122 that provides a fluid coupling between vacuum generator assembly 120 and particulate material aspirator 130. An optional pressure tube 180 may be used to provide a fluid coupling between air directing tube 110 and particulate material aspirator 130.

According to a preferred embodiment, air blower 150 is an ECHO® PB650 power blower manufactured by ECHO, INCORPORATED of Lake Zurich, Ill. The ECHO® PB650 includes a 63.3 cc two cycle engine capable of generating an air speed of 205 mph and an average air volume of 1200 cubic feet per minute, while having a dry weight of approximately 21 pounds. Smaller and larger leaf blowers can be used, as can other manufacturing sources, but smaller blowers tend to have lower volumetric flow, and larger ones tend to be undesirably heavy and expensive.

Figure 2:
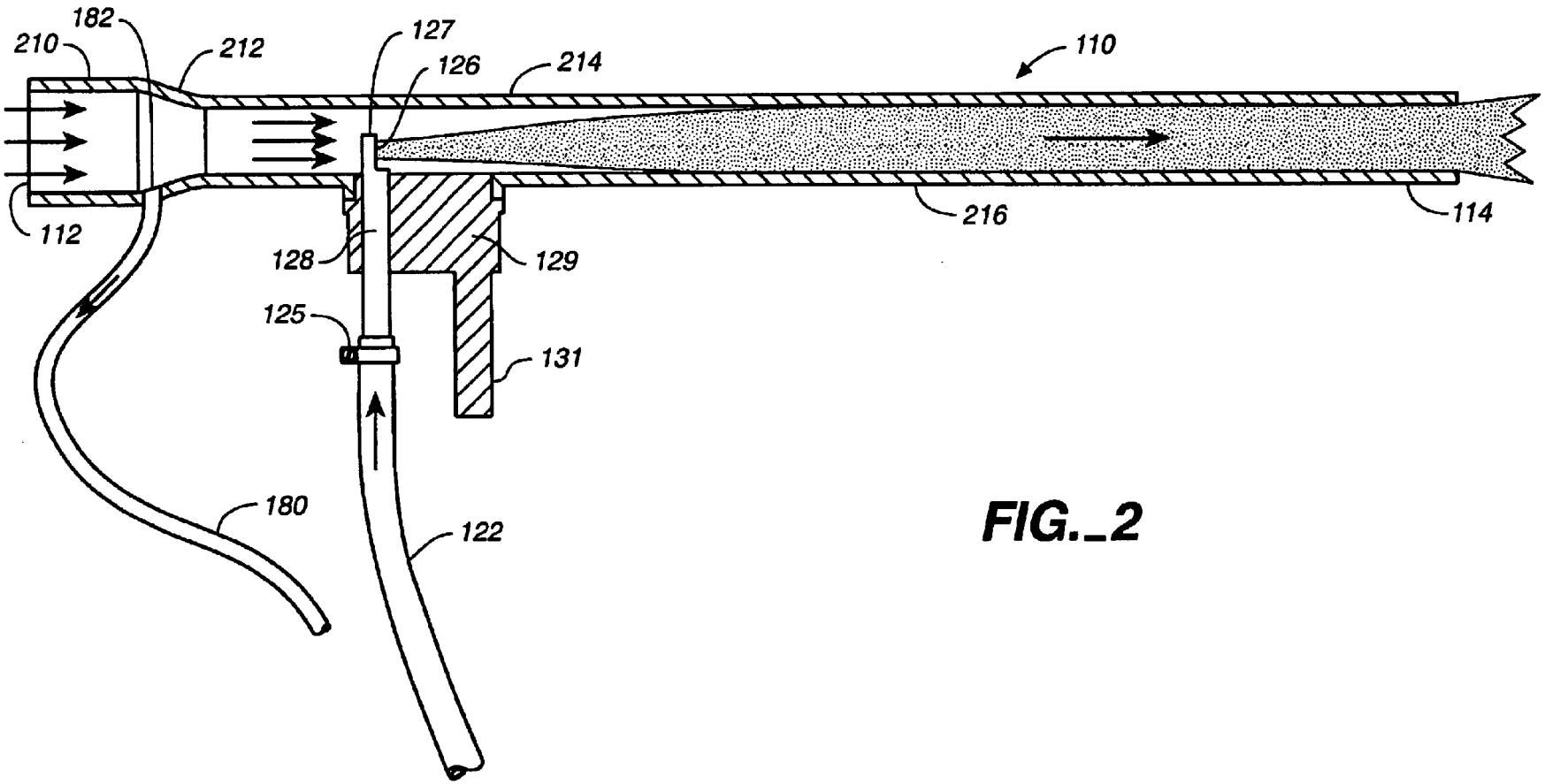
FIG. 2 is an enlarged, side elevation view, in cross-section, of the air and particle directing portion of the particular blaster assembly of FIG. 1.

As shown in FIG. 2, air directing tube 110 and can be divided into four separate but monolithically adjacent regions: an inlet section 210, an acceleration section 212, a vacuum generating section 214, and a mixing section 216. The inlet section 210 includes an inlet end 112 formed for coupling to a gas source, such as air blower 150. The inlet section 210 is configured to receive gas discharged from the gas source and to direct the received gas to frustoconical converging gas accelerating section 212.

The vacuum generating section 214 is positioned adjacent to the acceleration section 212 for receiving the gas and has vacuum generating assembly 120 mounted therein. Vacuum generating structure 120 can advantageously include a tube 128 having a notched open end 126 that is mounted in air directing tube 110 so as to extend at least partially across the tube with side notch 126 facing in a downstream direction. Air passing around the tube 128 will, therefore, create a partial vacuum or lowered pressure in the tube due to the Bernoulli effect of the air passing around the to and across the open end 127 of the tube.

As illustrated in FIG. 2, the vacuum generated by the vacuum generating assembly 120 is fluidly coupled to flexible vacuum tube 122. Vacuum generating tube 128 passes through a handle block 129 and is connected to vacuum conduit 122 by, for example, hose coupling 125.

Particulate material aspirator 130 is responsive to the partial vacuum generated by the vacuum generating assembly to aspirate the particulate material from particulate material source 340. The aspirated particulate material travels up vacuum conduit 122, through tube 128 and is sucked into air passing down air directing tube 110 for acceleration of particulate material 212 in the air directing tube and subsequent discharge from the exhaust end 114.

The mixing section 216 is positioned adjacent to the vacuum generating section 214 for receiving the air and mixing the air with and accelerating particulate material 212 entrained in the air so that it will be discharged at a sufficiently high velocity to be capable of sand-blasting effects.

Preferably, air directing tube 110 and vacuum generating assembly 120 are formed from a monolithic moldable material, such as, a polyurethane-based plastic. It is conceivable, however, that tube 110 or tube 128 may be metallic and that tube 110 can be formed in integrally joined sections.

As shown in FIG. 2, an assembly gripping section handle and a handle 131 can be provided on block 128 to facilitate manipulation of tube 110 during the blasting operation.

In order to enhance the fluidization and aspiration of particulate material, it is preferred that blaster 100 further include a positive pressure generating assembly which may be provided by an open end 182 of pressure conduit or hose 180 that preferably is located flush with the wall defining acceleration section 212 of air directing tube 110. The accelerating air in section 212 will pressurize flexible pressure conduit 180, and pressure conduit 180 may be fluidly coupled with aspirator assembly 130 in a manner described below.

Figure 3:
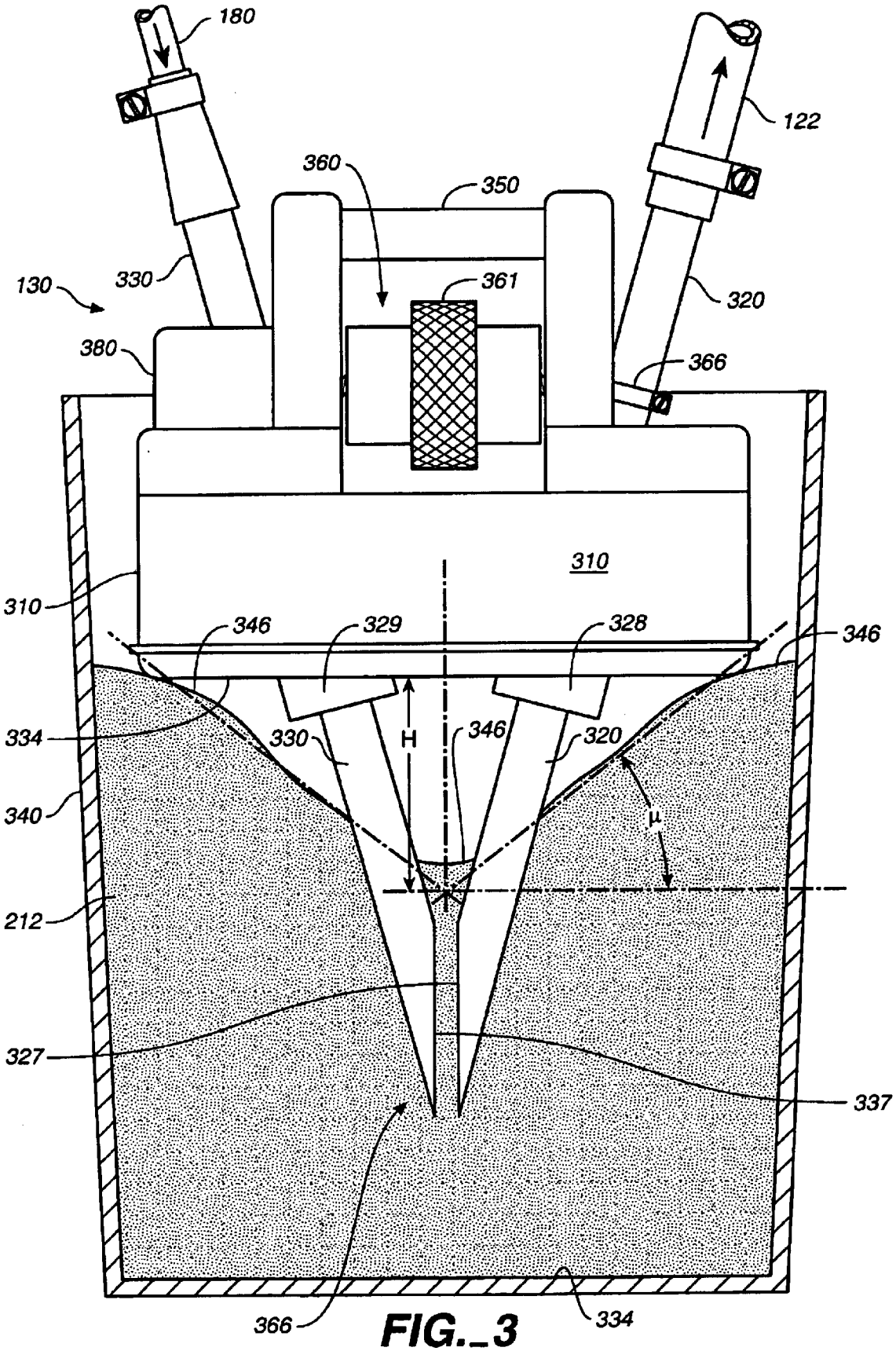
FIG. 3 is an enlarged, side elevation view, in partial cross-section, of the particulate material aspirator of FIG. 1.
Figure 4:
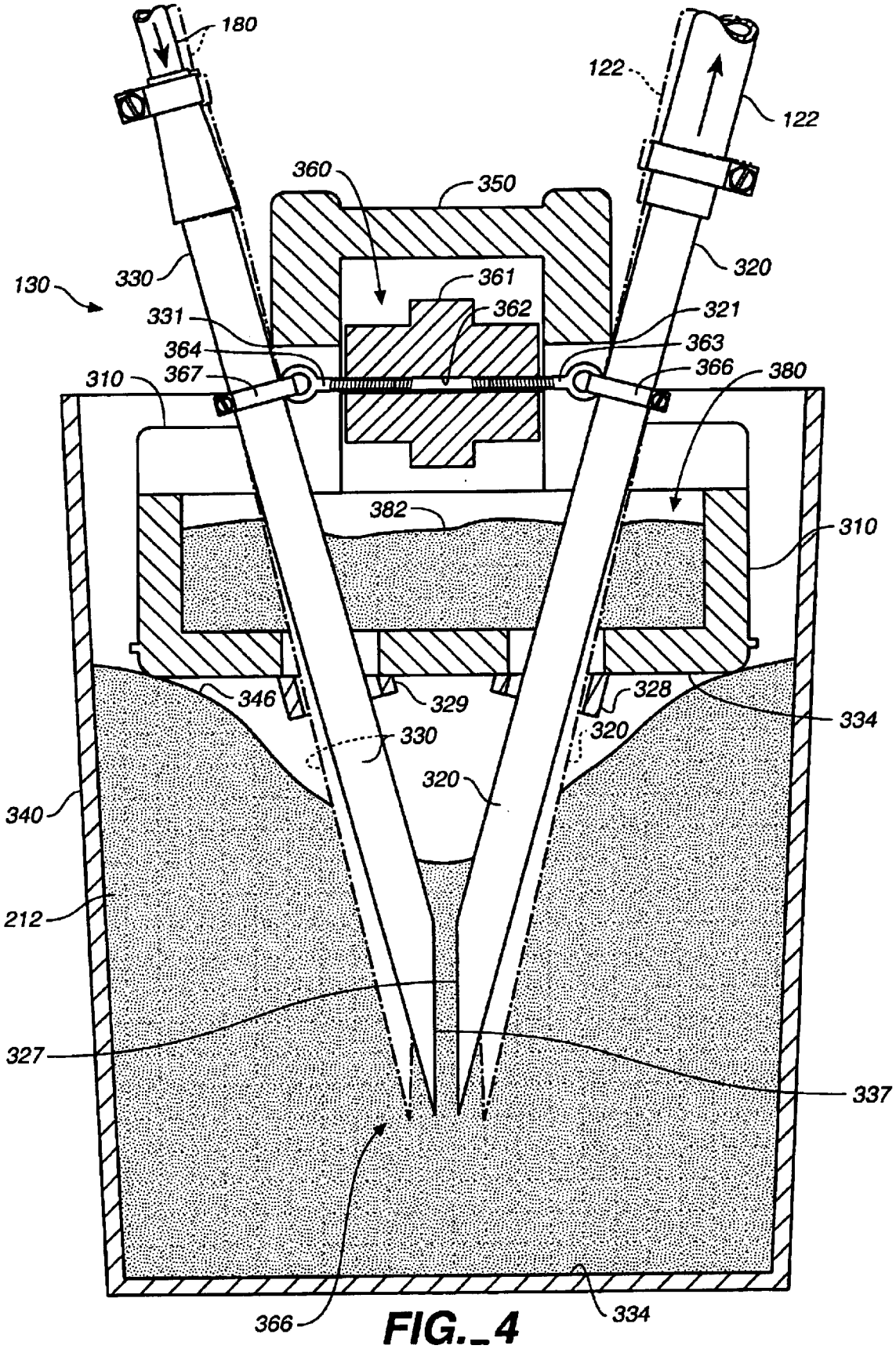
FIG. 4 is side elevation view, in cross-section, corresponding to FIG. 3, with the aspirating beak shown in phantom lines in a moved position.

Aspirator assembly 130, as best seen in FIGS. 3 and 4, includes a base member 310 to which vacuum conduit 122 is mounted and optionally, but preferably, to which pressure conduit 180 also is mounted. Base 310 rests on the upper surface 346 of a volume of particulate material 212 held in container 340. Base 310 preferably includes a handle 350 that allows the base and conduits to be lifted from container 340 for refilling. The base is smaller in diameter than container 340 so that the base can move downwardly within container 340 under the influence of gravity as sand or other particulate material is aspirated from the container. In order to assist downward gravity biasing the aspirator assembly 130, base 310 can be formed with an open upwardly facing top 380 into which particulate material, such as sand 382, may be placed (FIG. 4). Other weighting materials can be used and weighting of the base is not an absolute requirement.

Vacuum conduit 122 has a tube that passes through base 310 and extends downwardly therefrom to an open vacuum end 327 that is positioned below upper surface 346 of sand 312.

In the illustrated preferred embodiment, although not necessarily, vacuum conduit or its extension tube 320, is movably mounted to base 310, preferably by pivoting, so that the vacuum and pressure conduits can cooperate in aspirating sand.

Pressure conduit 180 may similarly be coupled to a tube 330 which passes through base 310, as best seen in FIG. 4, and extends therebelow to an open pressure end 337 below sand surface 346 and proximate open vacuum end 327 to cooperate in the aspiration of the particulate material from the container. The pressure conduit 180 and/or its extension tube 330 also is preferably, but not necessarily, movably or pivotally mounted with respect to base 350 for adjusting the position of open pressure end 337.

As particulate material is withdrawn from container 340 through vacuum tube 320 and hose 122, surface 346 assumes a conical surface having an apex proximate open vacuum end 327. The conical surface which results will have an angle of repose $\mu$ at which the particulate material will be self-supporting. Angle of repose $\mu$ will be characteristic of each particular material and grain size. A typical, but not limiting, range of angles of repose $\mu$ for sand will be between about 30 degrees and about 35 degrees, depending upon the particle size, density and moisture content. In the preferred embodiment, the open vacuum end 327 and the open pressure end 337 both are positioned below surface 346 at the apex of the angle of repose. The depth of open ends 327, 337 below the bottom surface 334 of base 310 is greater than the height, H, of angle of repose $\mu$ of particulate material 212 in container 340. This depth below surface 334 is preferably not so great as to quickly bottom out on the bottom wall 344 of the container.

According to a preferred embodiment, vacuum tube 320 is mounted in a sleeve 328 (FIG. 4) for guiding pivotal movement of the vacuum conduit. The pressure conduit 330 may also be mounted in a second sleeve 329 for pivotal movement.

Upper ends of conduits 320 and 330 are held against corners 321 and 331 of handle structure 350 by a turnbuckle assembly 360. Turnbuckle assembly 360 can include a knurled thumb wheel 361 having a transverse bore 362 with oppositely handed threads therein that threadably receive oppositely handed threaded eyebolts 363 and 364. The eyebolts are coupled by bands 366 and 367 to tubes 320 and 330, respectively.

Thumb wheel 361 will be seen to be trapped between uprights 368 and 369 of handle 350 so that rotation of thumb wheel 361 will pull eyebolts in or displace them out of bore 362. As the turnbuckle displaces eyebolt 363 and 364 outwardly, base and sleeves 328, 329 flex and allow beak openings 327 and 337 to come together from the position of FIG. 3 to the position of FIG. 4. Conduits 320 and 330 in essence pivot, or move, together. A variety of other methods are known and may be used to pivot or move conduit 320 and/or conduit 330 together and apart.

Turning turnbuckle 360 in one direction, therefore, results in reducing the distance between open vacuum end 327 and open pressure end 337. Turning the turnbuckle in the other direction results in increasing the distance between open ends 327 and 337. Typically, the separation ranges from substantially to zero to about ¼ inch. The turnbuckle is thereby capable of controlling the communication of positive pressure from hose 180 to the partial vacuum in hose 122 through the particulate material between the conduit open ends. Such cooperative communication between open pressure end 337 and open vacuum end 327 facilitate fluidization and aspiration of the particulate material.

In the preferred embodiment, open vacuum end 327 and the open pressure end 377 from the beak assembly 366 in which tubes 320 and 330 have been obliquely cut to produce open ends 327 and 337 which face each other. This structure has been found to be particularly effective in aspirating particulate material 212. The opening in beak assembly 366 can be varied to produce the most efficient aspiration of particulate material depending upon the material, particle size and moisture content.

Adjustment of beak assembly 366 can be accomplished at the start of a particulate blasting project by adjusting thumb wheel 360 to substantially close the beak. The thumb wheel can then be used to gradually open beak 366 until the air/particulate mixture discharged from tube 110 can be seen to be effective in eroding the target area. Opening the beak too far will slow particulate aspiration and the velocity of particulate discharge.

Optionally, a battery-powered vibrator 380 (FIG. 3) may be mounted to base 310 for agitating the base vacuum conduit tube 320, pressure conduit tube 330, and particulate material 212. Such agitation improves fluidization of the particulate material and tends to lower angle of repose $\mu$ somewhat and assist in the aspiration of the particulate material.

Components of the sandblaster assembly of the present invention may be made out of any suitable material including, but not limited to, rotation moldable material, such as polyurethane plastic. It is conceivable however, that individual components of the particulate blaster assembly and/or the aspirator assembly may be metallic or formed by techniques other than rotation molding Particulate blaster assembly 100 can easily be provided as an attachment for a convention leaf blower to provide the homeowner or small municipality with a low cost, highly mobile sandblasting capability. The present invention does not require bulky compressors or vast movable sand reservoirs.

For convenience in explanation and accurate definition in the appended claims, the terms "up" or "upper," "down" or "lower," "inside" and "outside" are used to describe features of the present invention with reference to the positions of such features as displayed in the figures.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A particulate blaster assembly for use as an attachment to a portable leaf blower comprising:

an air directing tube having an inlet end configured for coupling to the portable leaf blower to receive air discharged therefrom and having a movable exhaust end formed for discharge of air and particulate material entrained in the air toward a target site;

a vacuum generating structure fluidly coupled to the air discharge tube and formed to produce a partial vacuum as air passes in the tube beyond the vacuum generating structure; and a particulate material aspirator fluidly coupled to the vacuum structure and to the air discharge tube and responsive to the partial vacuum generated by the vacuum structure to aspirate a particulate material from a particulate material source into the air discharge tube for acceleration of the particulate material in the air discharge tube and discharge of air and entrained particulate material from the exhaust end and wherein, the particulate material source is provided as a volume of particulate material and wherein, the aspirator assembly is positioned in part below an upper surface of the volume of particulate material and wherein, the aspirator assembly includes a base movably supported on an upper surface of the particulate material, a vacuum conduit having an end coupled to the vacuum structure and an opposite open vacuum end, and the vacuum conduit being mounted to the base to extend downwardly therefrom into the particulate material for aspiration of particulate material under the partial vacuum generated by the vacuum structure.

2. The apparatus of claim 1, and a portable leaf blower, and wherein, the air directing tube is coupled to receive air from the portable leaf blower.

3. The apparatus of claim 1 wherein, the vacuum structure includes a vacuum tube having an end transversely disposed within the air directing tube, the vacuum tube including an opening facing downstream toward the exhaust end to produce a negative pressure as air moves past the vacuum tube.

4. The apparatus of claim 3 wherein, the end of the vacuum tube which is disposed in the air discharge tube extends only partially across the air discharge tube and opens in a direction perpendicular to air flow as well as having an opening facing away from the air flow.

5. The apparatus as defined in claim 1 wherein, the aspirator assembly further includes a pressure conduit mounted to the base and having a pressure end coupled to the air discharge tube;

and an opposite open pressure end mounted to the base and extending downwardly therefrom in sufficiently close proximity to the open vacuum end to facilitate the fluidization of the particulate material for aspiration.

6. The apparatus of claim 5 wherein, the open vacuum end and the open pressure end extend the top surface of the particulate material by a distance greater than the height dimension of the angle of repose of the particulate material.

7. The apparatus of claim 6 wherein, at least one of the vacuum conduit and the pressure conduit is adjustably mounted to enable variation in the distance between the open vacuum end and the open pressure end.

8. The apparatus of claim 7 wherein, the open vacuum end and the open pressure end are formed as a beak-like structure with obliquely oriented oppositely facing openings spaced apart for passage of the particulate material therebetween into the vacuum conduit.

9. The apparatus of claim 7 wherein, the vacuum conduit and pressure conduit are movably mounted to the base for adjusting the spacing between the obliquely oriented oppositely facing openings.

10. The apparatus of claim 1, and a vibrator coupled to the base and adapted to agitate the base to cause movement of the particulate material into the vacuum conduit.

11. The apparatus of claim 9 wherein, one of the vacuum conduit and the pressure conduit are pivotally mounted to the base, and an adjustment structure coupled to a pivotally mounted conduit and formed to pivot the pivotally mounted conduit to effect adjustment of the spacing therebetween the open vacuum end and the open pressure end.

12. The apparatus as defined in claim 11 wherein, the vacuum conduit and the pressure conduit are both pivotally mounted to the base, and the adjustment structure is provided by a turnbuckle assembly coupled between the vacuum conduit and the pressure conduit.

13. The apparatus of claim 5 wherein, the air discharge tube is formed with a tapered portion disposed between the inlet end and the vacuum structure, and the pressure conduit is fluidly coupled to the tapered portion of the air discharge tube.

14. An aspirator assembly responsive to a vacuum source to aspirate a particulate material from a particulate material source, the aspirator assembly comprising:

a base configured to rest on an upper surface of the particulate material and move under the force of gravity to follow the upper surface down am particulate material is aspirated from the particulate material source; and a vacuum conduit mounted to the base and extending downwardly below the base to an open vacuum end positioned in the particulate material in order to enable aspiration of the particulate material from the source, the vacuum conduit having an opposite end formed to be coupled to a vacuum source.

15. The apparatus of claim 14, and a pressure conduit mounted to the base and extending downwardly below the base to an open pressure end positioned in the particulate material, the pressure conduit having an input end adapted for coupling to a source of gas under a positive pressure; and the open vacuum end and the open pressure end being positioned sufficiently close together to cooperate in the aspiration of the particulate material from the particulate material source.

16. The apparatus of claim 15 wherein, the vacuum end and the pressure end define a beak, and the vacuum conduit and the pressure conduit are mounted to the base for adjustment of the opening between the beak.

17. The apparatus of claim 16 wherein, the length of the vacuum conduit and the length of the pressure conduit below the base positions opening between the beak below the altitude of an angle of repose of the particulate material.

18. The apparatus of claim 17 wherein, the ends of the vacuum conduit and the pressure conduit define oblique opposed spaced apart openings.

19. The apparatus of claim 1, wherein the volume of particulate material is provided in a container.

20. A particulate blaster assembly for use as an attachment to a portable leaf blower comprising;

an air directing tube having an inlet end configured for coupling to the portable leaf blower to receive air discharged therefrom and having a movable exhaust end formed for discharge of air and particulate material entrained in the air toward a target site;

a vacuum generating structure fluidly coupled to the air discharge tube and formed to produce a partial vacuum as air passes in the tube beyond the vacuum generating structure;

a particulate material aspirator fluidly coupled to the vacuum structure and to the air discharge tube and responsive to the partial vacuum generated by the vacuum structure to aspirate a particulate material from a particulate material source into the air discharge tube for acceleration of the particulate material in the air discharge tube and discharge of air and entrained particulate material from the exhaust end, and a vibrator coupled to the base and adapted to agitate the particulate material aspirator to cause movement of the particulate material into the particulate material aspirator.

* * * * *